United States Patent [19]

Glazer

[11] Patent Number: 4,901,874

[45] Date of Patent: Feb. 20, 1990

[54] BOTTLE HOLDER

[76] Inventor: Gdalia Glazer, 66/10 Jabotinsky St., Rishon LeZion, Israel

[21] Appl. No.: 279,605

[22] Filed: Dec. 5, 1988

[30] Foreign Application Priority Data

Dec. 8, 1987 [IL] Israel ..... 84746

[51] Int. Cl.[4] ..... B67B 7/44

[52] U.S. Cl. ..... 215/226; 215/244; 215/270; 81/3.15

[58] Field of Search ..... 81/3.07, 3.09, 3.15; 215/235, 244, 226, 100 A, 304, 237, 270; 222/473, 474, 475, 192; 7/151

[56] References Cited

U.S. PATENT DOCUMENTS

| | | | |
|---|---|---|---|
| 1,205,091 | 11/1916 | Hachmann | 215/226 |
| 1,446,474 | 2/1923 | Mahnken | 215/226 |
| 2,721,672 | 10/1955 | Fahle | 222/471 |
| 3,201,011 | 8/1965 | Brocken | 222/473 |
| 3,799,408 | 3/1974 | Palmer | 222/474 |
| 4,290,535 | 9/1981 | Reina | 215/270 |
| 4,667,359 | 5/1987 | Polotti | 81/3.09 |
| 4,768,403 | 9/1988 | Bar-Noy | 81/3.15 |

FOREIGN PATENT DOCUMENTS

| | | | |
|---|---|---|---|
| 2340865 | 9/1977 | France | 215/270 |

*Primary Examiner*—Roscoe V. Parker
*Attorney, Agent, or Firm*—Benjamin J. Barish

[57] ABSTRACT

A bottle holder comprises a handle manually graspable by a user, a cap remover carried by the handle for receiving, gripping and removing the cap of the bottle, an attachment member fixed to the handle, open at one end, and having internal threads at the opposite end for threading onto the external threads of the bottle neck, a closure pivotally mounted to the attachment member either to a closed position closing its open end or to an open position, and an operator carried by the handle and mechanically coupled to the closure to enable the operator, when operated by the user, to move the closure to either its open position or to its close position with respect to the open end of the attachment member.

11 Claims, 2 Drawing Sheets

FIG.1
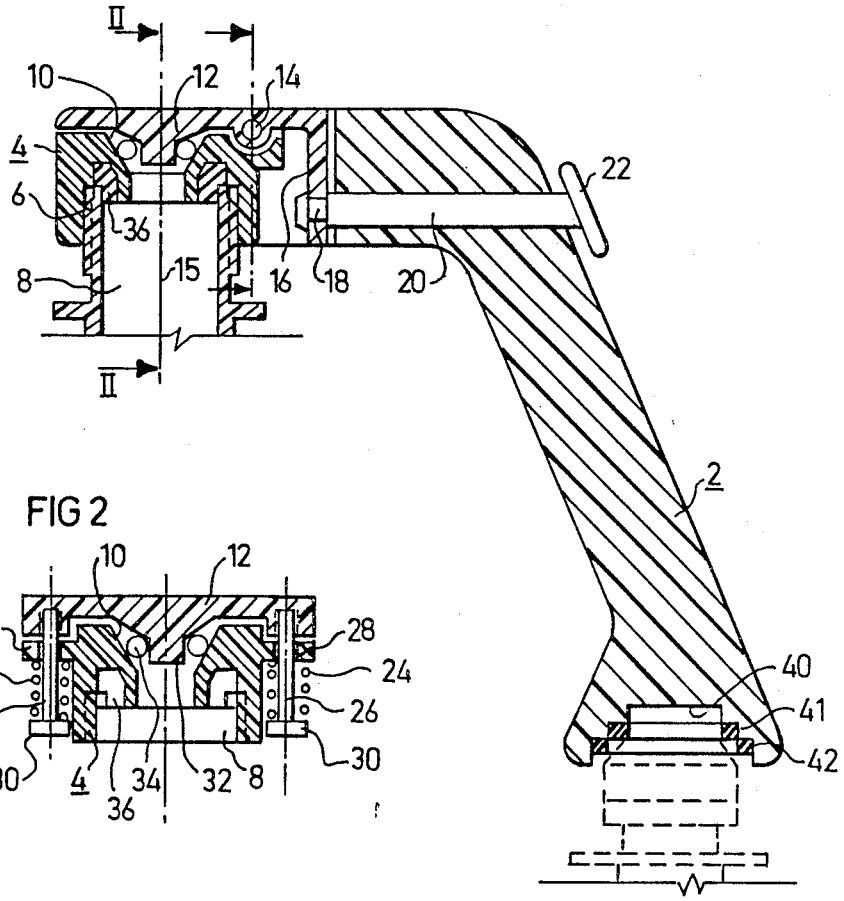
FIG 2
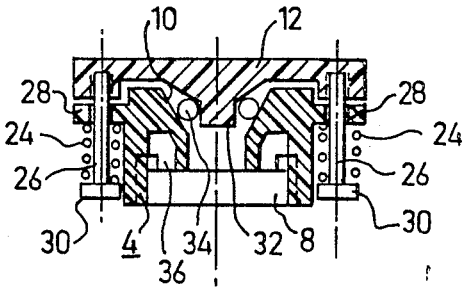
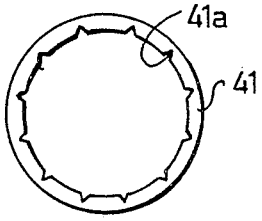
FIG.3
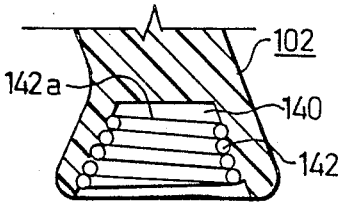
FIG 4

FIG. 5
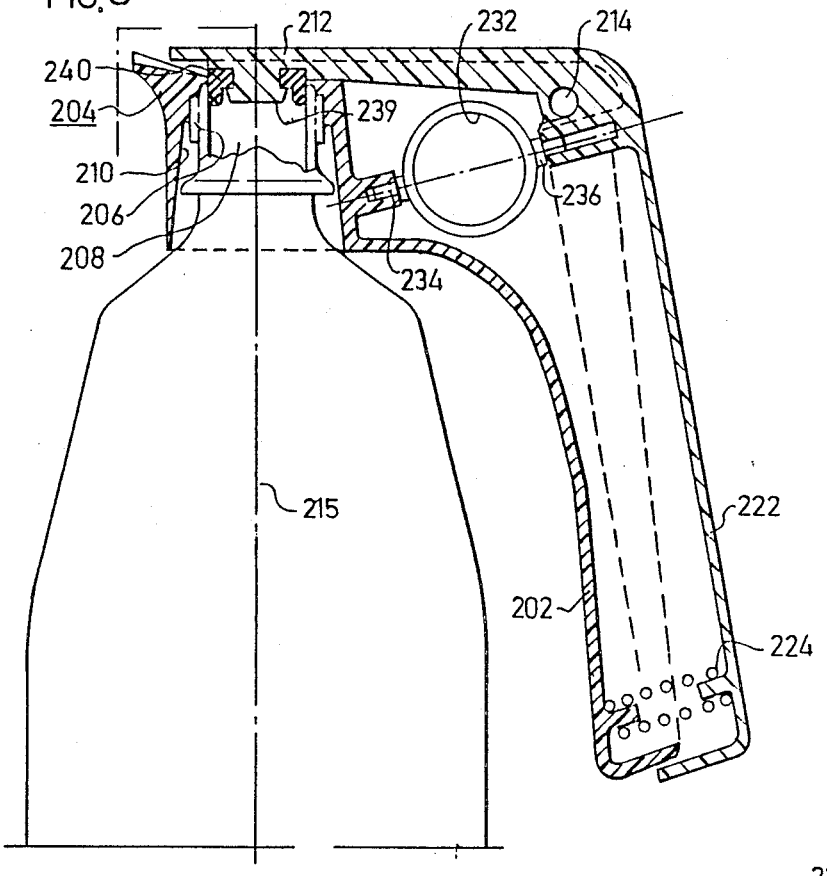
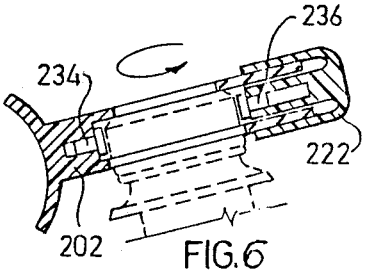
FIG. 6
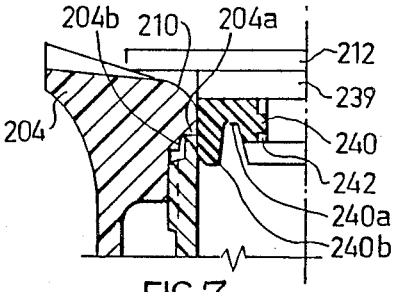
FIG. 7
FIG. 8
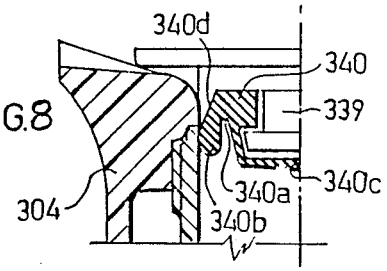

BOTTLE HOLDER

BACKGROUND OF THE INVENTION

The present invention relates to a bottle holder for use with conventional bottles, particularly plastic bottles, filled with carbonated beverages or other liquids.

Plastic bottles are increasingly being used for beverages and other liquids. In order to dispense the contents of the bottle, the user must grip the bottle, remove the cap, and then dispense its contents. This requires both hands and is somewhat awkward, particularly with the larger size bottles which can be difficult to hold. Moreover, the normal bottle cap is frequently difficult for the user to remove, and to be reapplied with a good seal.

A number of arrangements have previously been proposed, as illustrated for example in U.S. Pat. Nos. 2,046,804, 2,447,146 and 3,185,332, to facilite the removal of the normal bottle cap and for recapping it, but such arrangements do not include any means for conveniently holding the bottle when dispensing its contents. Other arrangements have been proposed, as illustrated for example in U.S. Pat. No. 3,847,311, for holding a container in order to dispense its contents, but such arrangements are not designed particularly for bottles, and/or do not include means for removing the bottle caps.

An object of the present invention is provide a bottle holder having advantages in the above respects.

BRIEF SUMMARY OF THE INVENTION

According to the present invention, there is provided a bottle holder for a bottle having a neck formed with external threads for receiving a cap, the bottle bolder comprising: a handle manually graspable by a user; a cap remover carried by the handle for receiving, gripping and removing the cap of the bottle by rotating the handle about the axis of the bottle neck; an attachment member fixed to one end of the handle, the attachment member having internal threads at one end for threading onto the external threads of the neck of the bottle, and being open at the opposite end; a closure movably mounted to the attachment member either to a closed position closing the open end of the attachment member, or to an open position with respect thereto; an operator carried by the handle and mechanically coupled to the closure to enable the operator, when operated by the user, to move the closure to either its open position or to its closed position with respect to the open end of the attachment member.

In one preferred embodiment of the invention described below, the operator is a push-button carried by the handle, and the closure is pivotally mounted to the attachment member. In that described embodiment, the cap remover for receiving, gripping and removing the cap of the bottle is formed at the end of the handle.

In a second preferred embodiment described below, the operator extends substantially parallel to the handle and is pivotally mounted thereto about an axis substantially perpendicularly to but laterally of the axis of the neck of the bottle. In that described embodiment, the cap remover includes a gripping surface formed at an intermediate portion of both the handle and the operator engageable with the opposite sides of the cap, when the operator is operated by the user, to grip the cap and thereby to facilitate its removal.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a longitudinal sectional view illustrating one form of bottle holder constructed in accordance with invention;

FIG. 2 is a sectional view along line II—II of FIG. 1;

FIG. 3 is an end view illustrating one of the metal rings in the cap gripping device at one end of the bottle holder of FIG. 1;

FIG. 4 illustrates another cap gripping device which may be used to facilitate the removal of a conventional bottle cap;

FIG. 5 is a longitudinal sectional view illustrating another form of bottle holder constructed in accordance with the invention;

FIG. 6 is a sectional view along lines VI—VI of FIG. 5;

FIG. 7 is an enlarged fragmentary view illustrating the sealing arrangement in the holder of FIG. 5; and FIG. 8 illustrates a variation in the sealing arrangement.

THE EMBODIMENT OF FIGS. 1–4

The bottle holder illustrated in FIGS. 1–4 comprises a handle, generally designated 2, which is manually graspable by a user, and an attachment member 4 fixed to one end of the handle. Attachment member 4 is formed with internal threads 6 at one end for threading onto the neck of a bottle 8. The opposite end of attachment member 4 is open and is circumscribed by a conical socket 10.

A closure 12 is pivotably mounted to attachment member 4 by a pin 14 extending perpendicularly to, but laterally of, the bottle neck axis 15. Closure 12 further includes an arm 16 connected at 18 to an operator 20 passing through the upper end of handle 2. The outer end of operator 20 carries a button 22 depressable by the user when holding handle 2, such that depressing the button pivots closure 12 from the illustrated closed position with respect to attachment member 4, to an open position.

Closure 12 is normally urged to its closed position as illustrated in FIGS. 1 and 2 by a pair of springs 24 interposed between opposite sides of attachment member 4 and the closure. As shown particularly in FIG. 2, each of the springs 24 is carried on a pin 26 passing through an enlarged opening 28 formed in the attachment member 4, and threaded into the closure 12. Each spring is interposed between a face of attachment member 4 and an enlarged head 30 formed in the pin 26. As also shown in FIG. 2, closure 12 is formed with a depending stem 32 of conical configuration, and also carries an O-ring 34 seatable on the conical seat 10 of the attachment member 4 in the closed position of the closure under the influence of the springs 24.

Attachment member 4 further includes a sealing ring 36 carried by the lower face of its conical seat 10. Sealing ring 36 is engageable with the bottle neck 8 to which the holder is attached, in order to provide a sealed closure of the bottle when the attachment member is so applied.

The end of handle 2 opposite to that carrying attachment member 4 is provided with a socket 40 containing a cap remover device for receiving and gripping the conventional bottle cap in order to facilitate removing it from a bottle. In the embodiment illustrated in FIG. 1, socket 40 includes two cap gripping sockets 41, 42, of different diameters, in order to accommodate different size caps. FIG. 3 illustrates one of the cap-gripping sockets 41, it being appreciated that the other cap-gripping socket 42 is of identical construction but of larger diameter.

Thus, as shown in FIG. 3, cap-gripping socket 41 includes a metal ring formed with a serrated inner edge 41*a* for gripping the conventional bottle cap when inserted into the ring. The conventional bottle cap is made of aluminum or other relatively soft metal, whereas ring 41 (as well as ring 42) is made of a relatively hard metal so that when the bottle cap is inserted into the ring, the serrated edge 41*a* of the ring bites into the cap and firmly grips it. This enables the user to use the handle 2 to remove the cap from the bottle.

The manner of using the device illustrated in FIGS. 1–4 of the drawings will be apparent from the above description. Thus, the end of the handle 2 formed with the socket 40 may first be used to remove the normal cap of a bottle. This is done by inserting the capped end of the bottle into the socket so that the cap is engaged and tightly gripped by the respective metal ring 41 or 42, depending on the size of the bottle cap, and then turning the holder about the longitudinal axis of the bottle neck. When the cap has been removed, the attachment member 4 at the opposite end of the holder is threaded onto the threaded neck of the bottle. Closure 12 of the attachment member 4 is normally urged to its closed position by springs 24 (FIG. 2).

Whenever it is desired to dispense liquid from the bottle, handle 2 is gripped by the user, and push-button 22 is depressed. This pivots closure 12 about pin 14 to its open position, thereby permitting the user to pour out contents from the bottle while still gripping handle 2. As soon as the user releases push-button 22, springs 24 return closure 12 to its normal closed position, tightly closing the open end of attachment member 4.

FIG. 4 illustrates a variation in the cap remover at the end of the handle, therein designated 102. Thus, as shown in FIG. 4, the cap remover is in the form of a conical socket 140 having an open spiral spring 142 of conical shape. The inner end 142*a* of the spring is fixed, whereas the outer end is free. Thus, upon insertion of a bottle containing a cap, the cap will firmly engage the spring at the portion thereof corresponding to the diameter of the cap; and upon rotation of the holder, the spiral spring will close to firmly grip the cap and thereby facilitate its removal.

THE EMBODIMENT OF FIGS. 5–7

FIGS. 5–7 illustrate another bottle holder constructed in accordance with the invention. The bottle holder illustrated in FIGS. 5–7 includes a handle 202 graspable by the user, and an attachment member 204 fixed to one end of the handle and having internal threads 206 for threading onto the externally threaded neck of a bottle 208. The opposite end of attachment member 204 is open and is formed with a conical socket 210. A closure 212 is pivotally mounted by a pin 214 to attachment member 204, and is connected to an operator 222 which is operated by the user to move the closure to either its open position or its closed position with respect to the open end of the attachment member 204.

In the embodiment illustrated in FIGS. 5–7, the operator 222 extends substantially parallel to the handle 202 and is pivotally mounted thereto about an axis, defined by pin 214, which is substantially perpendicular to but laterally of the longitudinal axis 215 of the bottle neck. As shown in FIG. 5, operator 222 complements the general outer configuration of handle 202 but is slightly longer than the handle, so that the handle can nest within the operator 222 when both the handle and the operator are squeezed towards each other by the user. The operator 222 is urged by a spring 224 to the position illustrated in FIG. 5, wherein the closure 212 is in its closed position, i.e., firmly seated within the bottle neck.

Handle 202 is formed, at an intermediate position thereof, with a circular cut-out 232 of a size slightly larger than the diameter of the conventional bottle cap. Cut-out 232 includes a radially-extending metal pin 234 aligned with another radially-extending metal pin 236 carried by the operator. Both pins serve as gripping surfaces which are engageable with the opposite sides of the bottle cap, when the handle and operator are squeezed together, to grip the cap and thereby to facilitate its removal by rotating the handle and operator about the axis 215 of the bottle neck.

Closure 212 carried by the operator 222 includes a stem 239 received within the neck of the bottle. A sealing ring 240 is applied to the outer surface of this stem so as to effect a seal between it and the inner face of the bottle neck when the stem is received therein.

As shown particularly in FIG. 7, sealing ring 240 is received within an annular groove 242 formed at the lower end of stem 239. In addition, the underface of sealing ring 240, namely the face facing the interior of the bottle when the closure stem 239 is inserted into the bottle neck, is formed with an annular recess 240*a*, which defines an outer flexible skirt 240*b* engageable with the inner face of the bottle neck. When the closure stem 239 is received within the bottle neck, and the interior of the bottle is pressurized (by the carbonizing gas therein), skirt 240*b* of the sealing ring 240 is deflected outwardly by the pressurized gas, thereby enhancing the seal between the closure stem 239 and the bottle neck.

As also shown in FIG. 7, the attachment member 204, attachable via its internal threads 206 to the external threads of the bottle neck, is formed with an annular shoulder 204*a* engageable with the outer tip of the bottle neck to limit the threading of the attachment member onto the bottle neck. The surface of attachment member 204 just underlying shoulder 204*a* is of conical configuration, as shown at 204*b*, to enhance the seal between the attachment member and the bottle neck.

The bottle holder illustrated in FIGS. 5–7 may be used in the following manner:

First, in order to remove the conventional bottle cap from the bottle, handle 202 and operator 222, both gripped by the user, are applied in a horizontal position over the bottle cap, with the cap received within the circular opening 232 formed in the handle. The handle and operator are then squeezed to cause the gripping pins 234 and 236, on opposite sides of this opening, to tightly engage the bottle cap, whereupon the handle and operator are rotated about the axis 215 of the bottle neck, to loosen and then remove the bottle cap.

After the bottle cap has thus been removed, the attachment member 204 is threaded around the bottle neck until the outer surface of the bottle neck engages annular shoulder 204*a* (FIG. 7) of the attachment member. During this procedure, operator 222 and handle 202 are squeezed together, so as to move the closure stem 239 away from the neck of the bottle; and when the bottle is firmly attached, the operator is released, whereupon spring 224 firmly moves the closure stem 239 into the bottle neck. In this closed position of the closure stem 239, a good seal is effected by sealing ring 240, this seal being enhanced by the pressure within the bottle which tends to deflect skirt 240*b* of the seal outwardly against the inner face of the bottle neck.

Whenever it is desired to dispense liquid from the bottle, handle 202 and operator 222 are grasped by the user and squeezed, whereupon the operator pivots about pin 214 to move the stem 239 of closure 212 out of the neck of the bottle, thereby permitting contents of the bottle to be dispensed while the bottle is conveniently held by handle 202 and operator 222. Release of the operator 222 will move the closure stem 239 back into the bottle neck by virtue of spring 224.

FIG. 4 illustrates a variation wherein the sealing ring, therein designated 340 is formed with a central membrane portion 340*a* receivable over the end of the stem 339, in addition to the annular recess 340*a* and flexible skirt 340*b* which is pressed against the inner face of the bottle received in the attachment member 304. This variation move positively assures a good seal between the cap stem 339 and the bottle.

While the invention has been described with respect to several preferred embodiments, it will be appreciated that many other variations, modifications and applications of the invention may be made.

What is claimed is:

1. A bottle holder for a bottle having a neck formed with external threads for receiving a cap, said bottle holder comprising:

a handle manually graspable by a user;

an attachment member fixed to one end of the handle, said attachment member having internal threads at one end for threading onto the external threads of the neck of the bottle, and being open at the opposite end;

a closure movably mounted to said attachment member either to a closed position closing said open end of the attachment member, or to an open position with respect thereto; and an operator carried by said handle and mechanically coupled to said closure to enable the operator, when operated by the user, to move said closure to either its open position or to its closed position with respect to the open end of said attachment member;

said closure including a stem carrying a sealing ring receivable within the neck of the bottle in the closed position of the closure;

said stem being formed with an annular groove receiving said sealing ring, the face of said sealing ring disposed inwardly of the bottle neck being formed with an annular recess defining an outer annular skirt deflectable outwardly by the pressure within the bottle to enhance the sealing effected by said sealing ring.

2. The bottle holder according to claim 1, wherein said operator extends substantially parallel to the handle and is pivotally mounted thereto about an axis substantially perpendicular to but laterally of the axis of the neck of the bottle.

3. The bottle holder according to claim 2, further including a spring interposed between said handle and operator and normally urging the operator to the closed position of the closure.

4. The bottle holder according to claim 2, wherein said closure is pivotally mounted to said attachment member to either the closed position of the closure closing the bottle neck, or to its open position spaced outwardly of the bottle neck.

5. The bottle holder according to claim 1, wherein said attachment member is formed with an outer conical surface bordering an annular shoulder both engageable with the outer tip of the bottle neck when the attachment member is attached thereto.

6. The bottle holder according to claim 1, further including a cap remover having a gripping surface formed at an intermediate location on the handle and a gripping surface formed at a corresponding location on the operator, said gripping surfaces being located to engage and grip the opposite sides of the cap, when the operator is operated by the user, and thereby to facilitate removal of the cap by rotating the handle about the axis of the bottle neck.

7. The bottle holder according to claim 6, wherein said gripping surfaces in the handle and operator are defined by pins fixed to said handle and operator.

8. A bottle holder for a bottle having a neck formed with external threads for receiving a cap, said bottle holder comprising:

a handle manually graspable by a user;

an attachment member fixed to one end of the handle, said attachment member having internal threads at one end for threading into the external threads of the neck of the bottle, and being open at the opposite end;

a closure movably mounted to said attachment member either to a closed position closing said open end of the attachment member, or to an open position with respect thereto;

an operator extending substantially parallel to and for substantially the complete length of the handle and pivotally mounted thereto about an axis substantially perpendicular to but laterally of the axis of the bottle neck;

said operator being fixed to said closure on one side of the pivotal mounting of the operator to the handle to enable the operator, when squeezed towards the handle, on the side opposite to said pivotal mounting, to pivot said closure to either its open position or to its closed position with respect to the open end of said attachment member;

said closure including a stem carrying a sealing ring receivable within the neck of the bottle in the closed position of the closure;

and spring means interposed between said handle and operator and normally urging the operator to the closed position of the closure.

9. The bottle holder according to claim 8, wherein said stem is formed with an annular groove receiving said sealing ring, the face of said sealing ring disposed inwardly of the bottle neck being formed with an annular recess defining an outer annular skirt deflectable outwardly by the pressure within the bottle to enhance the sealing effected by said sealing ring.

10. The bottle holder according to claim 8, wherein an intermediate portion of the handle includes a gripping surface engageable with one side of the cap, and an intermediate portion of said operator also includes a gripping surface engageable with the opposite side of the cap when the operator is operated by the user, to grip the cap and thereby to facilitate its removal by rotating the handle about the axis of the bottle neck.

11. The bottle holder according to claim 10, wherein said gripping surfaces in the handle and operator are defined by pins fixed to said handle and operator, respectively.

* * * * *